US008539643B2

(12) United States Patent
Hung

(10) Patent No.: US 8,539,643 B2
(45) Date of Patent: Sep. 24, 2013

(54) DAMPED HINGE AND CONTROL DEVICE THEREOF

(75) Inventor: Fang-Hsing Hung, Taipei (TW)

(73) Assignee: E Tai Enterprise Co., Ltd., Keelung (TW)

( * ) Notice: Subject to any disclaimer, the term of this patent is extended or adjusted under 35 U.S.C. 154(b) by 141 days.

(21) Appl. No.: 13/102,874

(22) Filed: May 6, 2011

(65) Prior Publication Data

US 2012/0279015 A1 Nov. 8, 2012

(51) Int. Cl.
*E05D 5/02* (2006.01)

(52) U.S. Cl.
USPC ..... 16/252; 16/54; 16/58

(58) Field of Classification Search
USPC ..... 16/252, 50, 54, 58
See application file for complete search history.

(56) References Cited

U.S. PATENT DOCUMENTS 4,847,946 A * 7/1989 Nam et al. ..... 16/53
7,900,319 B2 * 3/2011 Bacchetti ..... 16/252
2006/0207060 A1 * 9/2006 Cheng ..... 16/252
2009/0007379 A1 * 1/2009 Zhang et al. ..... 16/295
2010/0199459 A1 * 8/2010 Bacchetti ..... 16/54
2012/0216370 A1 * 8/2012 Chow ..... 16/54

FOREIGN PATENT DOCUMENTS

WO WO 2007125524 A1 * 11/2007

* cited by examiner

*Primary Examiner* — Victor Batson
*Assistant Examiner* — Matthew Sullivan
(74) *Attorney, Agent, or Firm* — Li & Cai Intellectual Property (USA) Office

(57) ABSTRACT

A damped spring hinge is disclosed, which includes a shaft seat, a shaft, a sleeve, a sliding member, an elastic unit, a non-return valve, a throttle valve. The shaft seat has a seat body, wherein a shaft hole and a receiving hole are formed in the seat body. The shaft can be rotatably disposed in the shaft hole. The sleeve is received in the receiving hole. The sliding member can be slidably disposed in the sleeve. An oil reservoir is formed by the sliding member and the sleeve. The elastic unit is disposed in between the sleeve and the sliding member. The non-return valve is disposed in the oil reservoir, and the throttle valve is disposed on the seat body. Thereby, a self-closing action for the door can be generated, along with the damping effect by the hydraulic oil. A control device of the damped spring hinge is also disclosed.

12 Claims, 6 Drawing Sheets

DAMPED HINGE AND CONTROL DEVICE THEREOF

BACKGROUND OF THE INVENTION

1. Field of the Invention

The instant disclosure relates to a hinge for glass doors; more particularly, to a damped spring hinge and a control device thereof.

2. Description of Related Art

Glass doors are frequently used in public buildings and shower rooms. Most glass doors can be closed automatically. Conventional glass doors are usually hinged to fixed walls or glass panels. Springs are normally used for the self-closing hinges, which tend to generate excessive impacts as the doors close.

To address the above issue, the inventor proposes the following solution.

SUMMARY OF THE INVENTION

One aspect of the instant disclosure is to provide a damped spring hinge and a control device thereof. An elastic unit would generate the self-closing action, while the control device provides damping with hydraulic oil to reduce door impact.

Another aspect of the instant disclosure is to provide a damped spring hinge and a control device thereof, wherein a throttle valve is used to adjust the flow of hydraulic oil for controlling the door closing speed.

The damped spring hinge comprises: a shaft seat having a seat body with a shaft hole and a receiving hole formed therein, wherein the shaft hole is passaged to the receiving hole, with a oil conduit being formed in the seat body for connecting to the shaft hole and the receiving hole at opposite ends; a shaft rotatably disposed in the shaft hole, wherein a fixing surface is formed on the shaft; a sleeve disposed in the receiving hole; a sliding member having an opening formed on one end thereof slidably disposed in the sleeve, wherein an oil reservoir for hydraulic oil is formed by the sliding member and the sleeve, and wherein one end of the sliding member abuts to the fixing surface; an elastic unit disposed in between the sleeve and the sliding member; a non-return valve disposed in the oil reservoir; a throttle valve disposed on the shaft seat and extends to the oil conduit; a first connecting member connected to the shaft seat; and a second connecting member connected to the shaft.

The control device of the damped spring hinge comprises: a shaft seat having a seat body with a shaft hole and a receiving hole formed therein, wherein the shaft hole is passaged to the receiving hole, with a oil conduit being formed in the seat body for connecting to the shaft hole and the receiving hole at opposite ends; a shaft rotatably disposed in the shaft hole, wherein a fixing surface is formed on the shaft; a sleeve disposed in the receiving hole; a sliding member having an opening formed on one end thereof slidably disposed in the sleeve, wherein an oil reservoir for hydraulic oil is formed by the sliding member and the sleeve, and wherein one end of the sliding member abuts to the fixing surface; an elastic unit disposed in between the sleeve and the sliding member; a non-return valve disposed in the oil reservoir; and a throttle valve disposed on the shaft seat and extends to the oil conduit.

The instant disclosure has the following advantage. The control device is comprised of a shaft seat, a shaft, a sleeve, an elastic unit, a non-return valve, and a throttle valve. The control device has an oil reservoir and a oil conduit formed therein for circulating hydraulic oil. When the door shuts, the fixing surface is restored to the original position by the sliding member due to the elastic unit. At such state, the sliding member is slid away from the sleeve. The hydraulic oil would push a closing member toward an orifice of a valve seat to create a seal. Thereby, the hydraulic oil can only return to the reservoir by circulating through the oil conduit. A throttle valve of the oil conduit regulates the oil flow for controlling the damping effect. Thus, less impact can be generated when shutting the door.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF PREFERRED EMBODIMENTS

Figure 1:
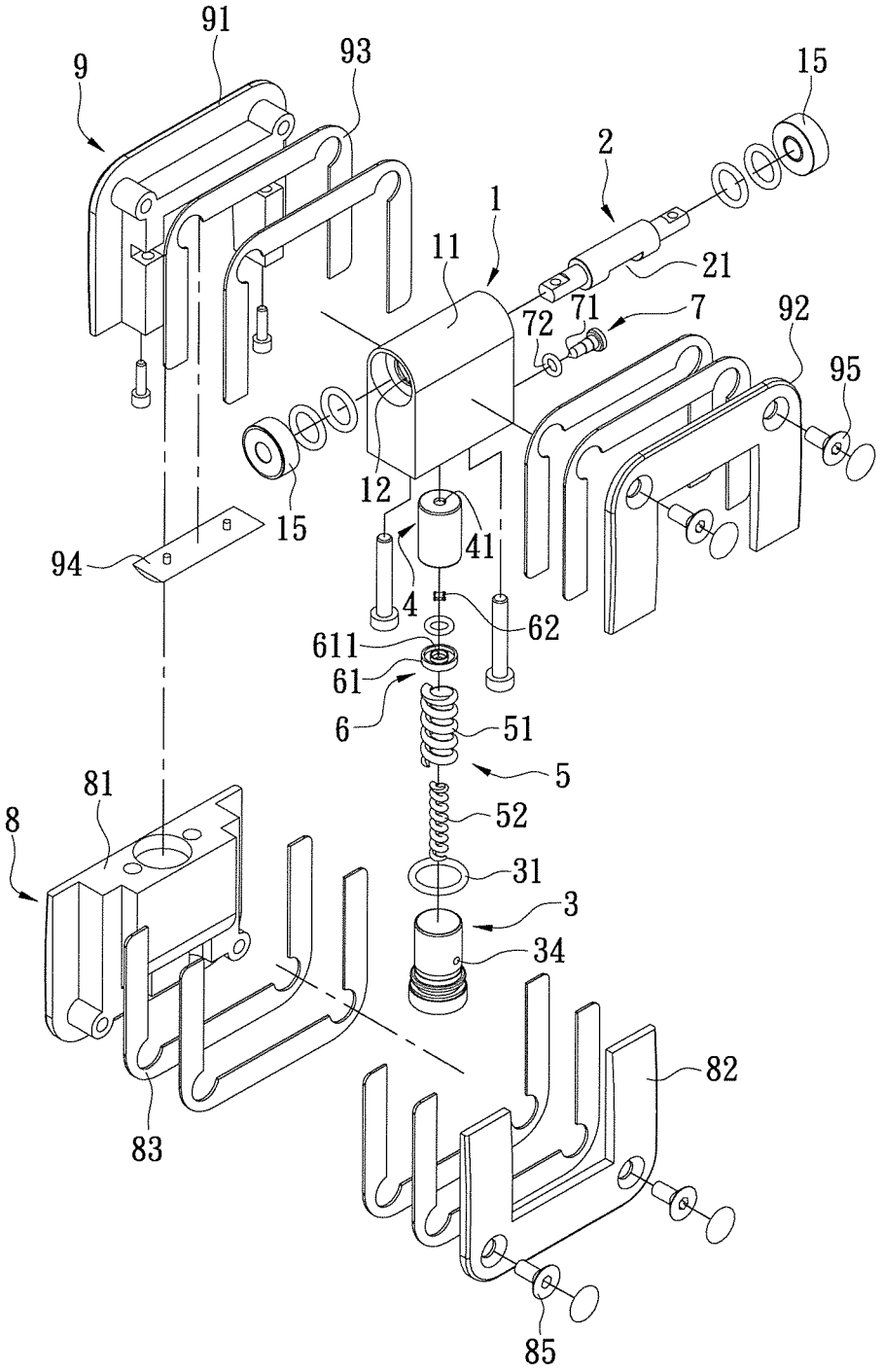
FIG. 1 is an exploded view of a damped spring hinge of the instant disclosure.
Figure 2:
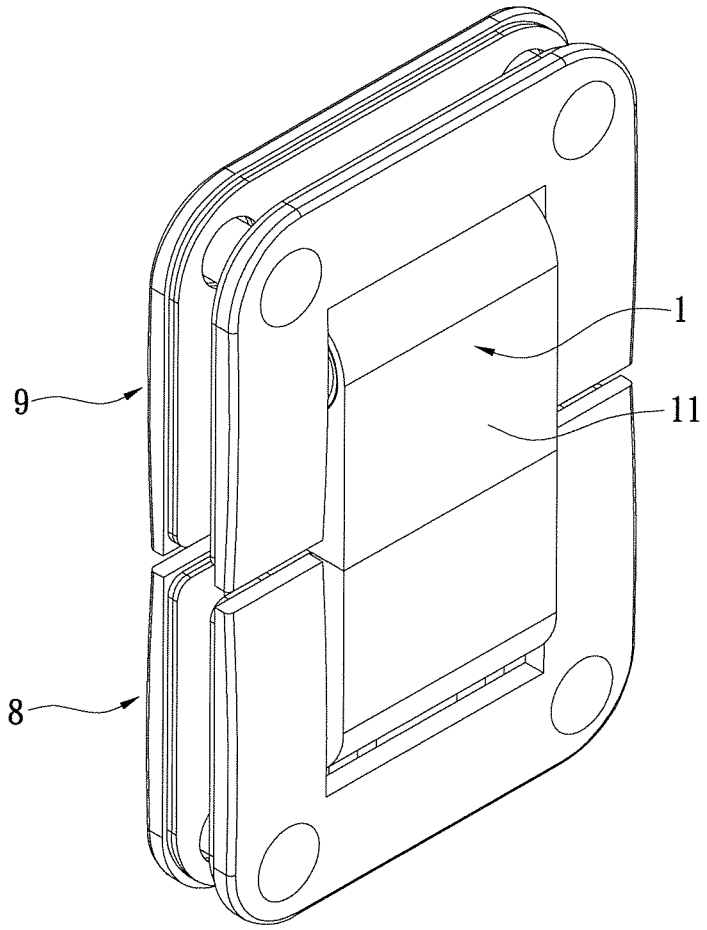
FIG. 2 is a perspective view of the damped spring hinge of the instant disclosure.
Figure 3:
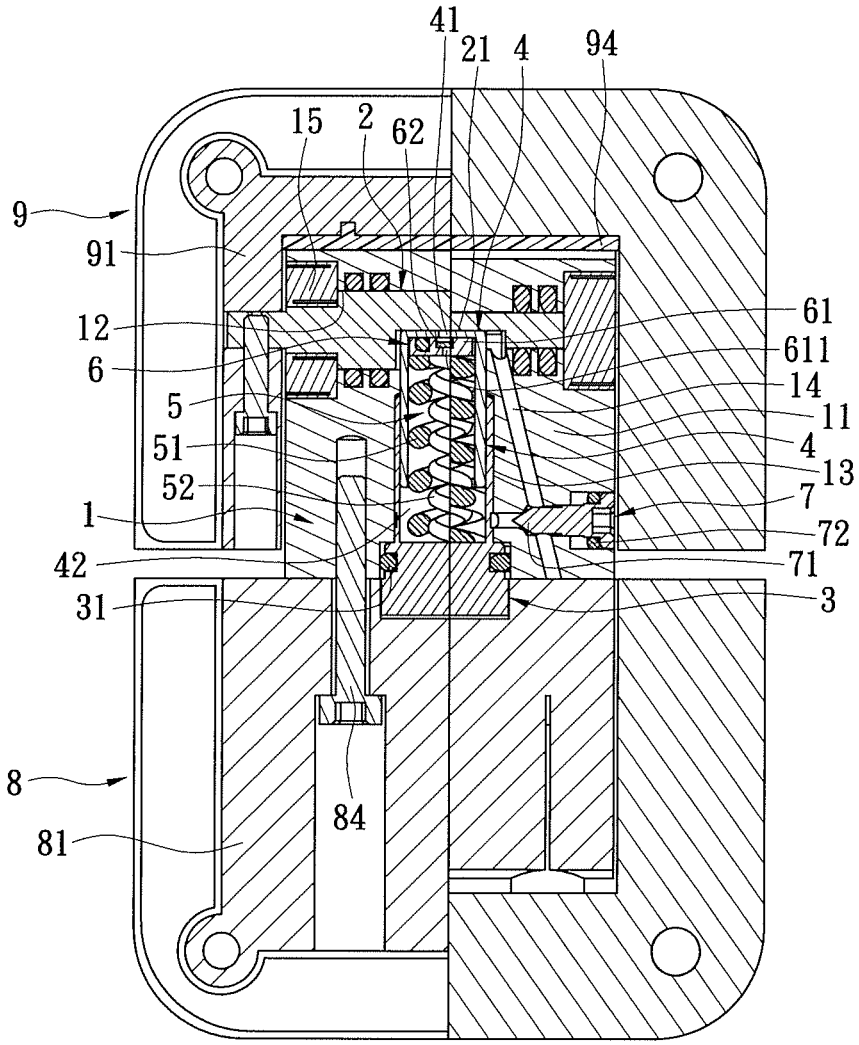
FIG. 3 is a sectional view of the damped spring hinge of the instant disclosure.

Please refer to FIGS. 1~3, which show a damped spring hinge for a first embodiment of the instant disclosure. The hinge can secure the door (e.g. glass door) pivotally to the wall or the glass panel. For the instant embodiment, a glass-on-glass type hinge is disclosed.

The hinge comprises a shaft seat 1, a shaft 2, a sleeve 3, a sliding member 4, an elastic unit 5, a non-return valve 6, a throttle valve 7, a first connecting member 8, and a second connecting member 9. The shaft seat 1 has a seat body 11, which has a shaft hole 12 and a receiving hole 13 formed therein. The shaft hole 12 is projected thru the seat body 11 from side to side. The receiving hole 13 is open to another side of the seat body 11 on one end and passaged to the shaft hole 12 on the opposite end. An oil conduit 14 is formed inside the seat body 11 for oil circulation, wherein the opposite ends of the oil conduit 14 is connected to the shaft hole 12 and the receiving hole 13.

The shaft 2 can be rotatably disposed in the shaft hole 12 of the seat body 11. A bearing 15 is disposed at opposite ends of the shaft 2 in the seat body 11 for smooth shaft rotation. Both ends of the shaft 2 protrude from the shaft seat 1 for securing to the second connecting member 9. A flat fixing surface 21 is formed on the middle portion of the shaft 2 for door (e.g. glass door) rotation purpose. The fixing surface 21 is arranged to face the receiving hole 13.

The sleeve 3 has a tubular body for disposing in the receiving hole 13 of the seat body 11. An O-ring 31 is disposed on the sleeve 3 in the receiving hole 13 to improve sealing. The sleeve 3 can be filled with the hydraulic oil to seal one end of the receiving hole 13. An opening 34 is formed on one side of the sleeve 3 that communicates with the oil conduit 14.

The sliding member 4 is barrel-shaped having a closed end with a thru hole 41 formed thereon, with an opposite end being open-ended. The sliding member 4 can be slidably disposed in the sleeve 3, wherein the sliding member 4 can slide back and forth therein. Together, the sleeve 3 and the sliding member 4 form an enclosure for storing hydraulic oil, thus an oil reservoir 42 is established. The holed end of the sliding member 4 abuts to the fixing surface 21 of the shaft 2.

The elastic unit 5 includes at least a coil spring. For the instant embodiment, a first spring 51 and a second spring 52 are disposed in the oil reservoir 42. The first and second springs 51 and 52 abut to the sleeve 3 on one end and the sliding member 4 indirectly on the opposite end. By disposing the elastic unit 5 in between the sleeve 3 and the sliding member 4, the sliding member 4 can be actuated. In other words, the sliding member 4 can abut to the fixing surface 21 of the shaft 2 elastically, wherein the elastic unit 5 provides the restoring energy for the self-closing door.

The non-return valve 6 is disposed within the oil reservoir 42. As long as the non-return valve 6 can block reverse flow, there is no structural restriction for the non-return valve 6. For the instant embodiment, the non-return valve 6 has a valve seat 61 and a closing member 62. An orifice 611 is formed on the valve seat 61. The closing member 62 is disposed at one side of the valve seat 61 and aligns to the orifice 611. The closing member 62 is disposed in between the valve seat 61 and the thru hole 41 of the sliding member 4. The above arrangement lets the hydraulic oil to flow in one direction only. In other words, the hydraulic oil of the oil reservoir 42 can only flow in the direction from the orifice 611 of the valve seat 61 to the thru hole 41 of the sliding member 4. If the oil flows in reverse direction, the reverse flow would move the closing member 62 to abut against the orifice 611 of the valve seat 61 in creating a seal. Thus, backflowing is prevented in achieving the non-return effect. The elastic unit 5 (first spring 51 and the second spring 52) abuts to the valve seat 61 on one end. Thus, the spring force of the elastic unit 5 is transmitted by the valve seat 61 to actuate the sliding member 4.

The throttle valve 7 is disposed on the shaft seat 1. For the instant embodiment, the throttle valve 7 is bolted to the seat body 11 of the shaft seat 1. The throttle valve 7 has a tapered portion 71 on one end that extends into the oil conduit 14 and near the opening 34 of the sleeve 3. Thereby, the throttle valve 7 can be used to adjust the oil flow through the oil conduit 14 to change the damping effect accordingly. An O-ring 72 is disposed on the throttle valve 7 in the seat body 11 for sealing.

The first connecting member 8 and the second connecting member 9 connect to the shaft seat 1 and the shaft 2 respectively. The first connecting member 8 includes a first press plate 81 and a second press plate 82. A plurality of gaskets 83 are disposed in between the first and second press plates 81 and 82. Two fasteners 84, such as pins, are used to secure the first press plate 81 onto the shaft seat 1. Meanwhile, a plurality of fasteners 85 can be used to mount the first and second press plates 81 and 82 onto the glass panels.

The second connecting member 9 includes a third press plate 91 and a fourth press plate 92. Likewise, a plurality of gaskets 93 are disposed in between the third and fourth press plates 91 and 92. A sealing cover 94 is pinned or glued to one end of the third press plate 91. The sealing cover 94 is disposed in between the shaft seat 1 and the second connecting member 9 to improve sealing. A plurality of fasteners 95 can be used to mount the third and fourth press plates 91 and 92 onto the doors (e.g. glass doors). Thereby, the door can be secured pivotally to the fixed glass panel for opening and closing.

Figure 4:
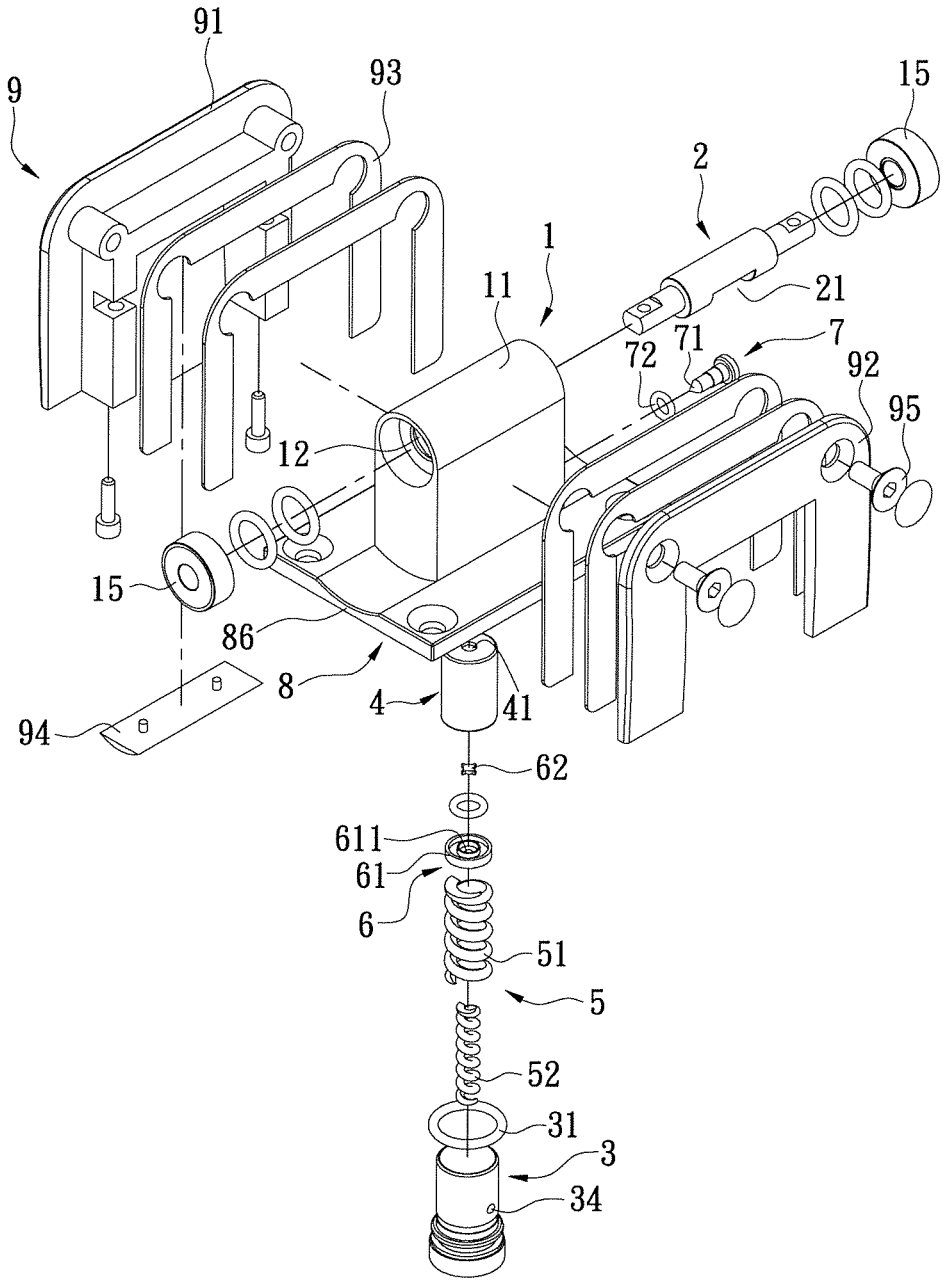
FIG. 4 is an exploded view of a damped spring hinge for another embodiment of the instant disclosure.
Figure 5:
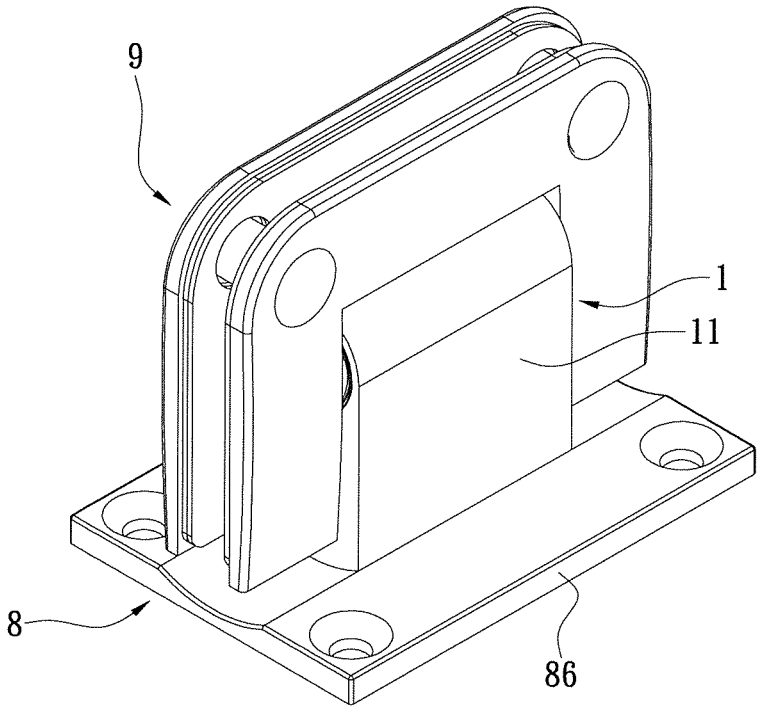
FIG. 5 is a perspective view of the damped spring hinge for the other embodiment of the instant disclosure.
Figure 6:
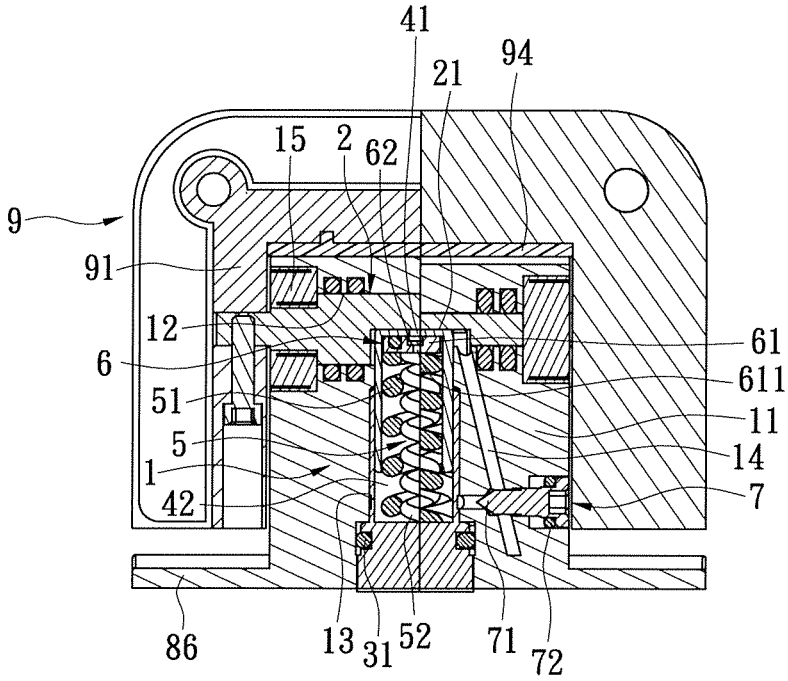
FIG. 6 is a sectional view of the damped spring hinge for the other embodiment of the instant disclosure.

Please refer to FIGS. 4~6, which show a glass-on-wall type hinge for mounting the glass door pivotally to the wall for a second embodiment of the instant disclosure. Compare to the first embodiment, the only difference is the first connecting member 8 of the instant embodiment has a base 86. The base 86 is fixed to the shaft seat 1. Meanwhile, fasteners (not shown) can be used to secure the base 86 onto the wall.

For the instant disclosure, the self-closing actuation is provided by the elastic unit 5. As shown in FIG. 3, when the door is closing, the elastic unit 5 pushes the sliding member 4 to abut the fixing surface 21 of the shaft 2 elastically. When the door (e.g. a glass door) is rotatably opening (not shown), the second connecting member 9 enables the shaft 2 to rotate in the shaft hole 12. The rounded portion of the shaft 2 forces against the sliding member 4 to collapse the elastic unit 5, thus allowing the door to be opened. When closing, the sliding member 4 is pushed by the spring force as the elastic unit 5 releases. Thereby, the sliding member 4 turns the shaft 2 as the fixing surface 21 returns to the original state to complete the self-closing action.

The control device of the instant disclosure is comprised of the shaft seat 1, the shaft 2, the sleeve 3, the sliding member 4, the elastic unit 5, the non-return valve 6, and the throttle valve 7. Plus, for the control device, the oil reservoir 42 and the oil conduit 14 for oil circulation are formed therein. When the door swings open, the shaft 2 is rotated against the sliding member 4, which collapses the elastic unit 5 for the door to be opened. At such state, the sliding member 4 is moved toward the sleeve 3, wherein the oil reservoir 42 is squeezed in becoming smaller. As a result, the stored hydraulic oil is forced to exit through the orifice 611 of the valve seat 61. No damping effect is created at this point, wherein the door can be easily opened.

When the door closes, the sliding member 4 is actuated by the spring force as the elastic unit 5 releases. The actuated sliding member 4 would turn the shaft 2 and abuts the fixing surface 21 as prior to the door being opened. At such state, the sliding member 4 moves away from the sleeve 3 as the oil reservoir 42 is expanded. The hydraulic oil would flow in reverse direction and push the closing member 62 against the orifice 611 of the valve seal 61 to create a seal. Thus, a non-return effect is created, wherein the hydraulic oil can only return to the oil reservoir 42 by circulating through the oil conduit 14. To adjust the oil flow, the throttle valve 7 is disposed in the oil conduit 14 to control the damping effect. Thereby, less impact is created when the door is self-closing.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A damped spring hinge, comprising:

a shaft seat having a seat body, the seat body having a shaft hole, a receiving hole, and an oil conduit formed therein, the receiving hole communicated with the shaft hole, the oil conduit connecting the shaft hole and the receiving hole at the opposite end portions thereof;

a shaft rotatably disposed in the shaft hole of the seat body having a fixing surface is formed on the middle portion thereof;

a sleeve sealingly disposed in the opening of the receiving hole;

a sliding member having a thru hole formed on one end thereof slidably mated with the sleeve, wherein the thru hole end thereof abuts the fixing surface of the shaft, wherein the sliding member and the sleeve jointly defines an oil reservoir for storing hydraulic oil;

an elastic unit disposed in the oil reservoir between the sleeve and the sliding member;

a one-way valve disposed in the oil reservoir between the thru hole end of the sliding member and the elastic member;

a throttle valve extending into the conduit of the shaft seat for regulating oil flow in the oil conduit;

a first connecting member fixedly coupled to the shaft seat; and a second connecting member rotatably coupled to the shaft;

wherein an opening is formed on one side of the sleeve and open to the oil conduit, the throttle valve is bolted to the seat body of the shaft seat, and the throttle valve has a tapered portion at one end for extending to the oil conduit and near the opening of the sleeve.

2. The damped spring hinge of claim 1, wherein a sealing cover is disposed on the second connecting member and between the second connecting member and the seat body of the shaft seat.

3. The damped spring hinge of claim 1, wherein the elastic unit comprises a first spring and a second spring, the first and second springs being disposed in the oil reservoir with one end of each abuts to the sleeve and another end of each abuts indirectly to the sliding member.

4. The damped spring hinge of claim 1, wherein the one-way valve comprises a valve seat and a closing member, wherein an orifice is formed on the valve seat, wherein the closing member is disposed on one side of the valve seat and aligns to the orifice, and wherein the elastic unit abuts to the valve seat.

5. The damped spring hinge of claim 1, wherein a bearing is disposed at opposite ends of the shaft in the shaft hole.

6. The damped spring hinge of claim 1, wherein the first connecting member has a first press plate and a second press plate, wherein a plurality of gaskets is disposed in between the first and second press plates, and wherein the first press plate is fixed to the shaft seat.

7. The damped spring hinge of claim 1, wherein the second connecting member has a third press plate and a fourth press plate, and wherein a plurality of gaskets are disposed in between the third and fourth press plates.

8. The damped spring hinge of claim 1, wherein the first connecting member has a base fixed to the shaft seat.

9. A control device of the damped spring hinge, comprising:

a shaft seat having a seat body, the seat body having a shaft hole, a receiving hole, and an oil conduit formed therein, the receiving hole communicated with the shaft hole, the oil conduit connecting the shaft hole and the receiving hole at the opposite end portions thereof;

a shaft rotatably disposed in the shaft hole of the seat body having a fixing surface is formed on the middle portion thereof;

a sleeve sealingly disposed in the opening of the receiving hole;

a sliding member having a thru hole formed on one end thereof slidably mated with the sleeve, wherein the thru hole end thereof abuts the fixing surface of the shaft, wherein the sliding member and the sleeve jointly defines an oil reservoir for storing hydraulic oil;

an elastic unit disposed in the oil reservoir between the sleeve and the sliding member;

a one-way valve disposed in the oil reservoir between the thru hole end of the sliding member and the elastic member; and a throttle valve extending into the conduit of the shaft seat for regulating oil flow in the oil conduit;

wherein an opening is formed on one side of the sleeve and open to the oil conduit, the throttle valve is bolted to the seat body of the shaft seat, and the throttle valve has a tapered portion at one end for extending to the oil conduit and near the opening of the sleeve.

10. The control device of the damped spring hinge of claim 9, wherein the elastic unit comprises a first spring and a second spring, the first and second springs being disposed in the oil reservoir with one end of each abuts to the sleeve and another end of each abuts indirectly to the sliding member.

11. The control device of the damped spring hinge of claim 9, wherein the one-way valve comprises a valve seat and a closing member, wherein an orifice is formed on the valve seat, wherein the closing member is disposed on one side of the valve seat and aligns to the orifice, and wherein the elastic unit abuts to the valve seat.

12. The control device of the damped spring hinge of claim 9, wherein a bearing is disposed at opposite ends of the shaft in the shaft hole.

* * * * *